US009439474B2

(12) United States Patent
Braunschweiler

(10) Patent No.: US 9,439,474 B2
(45) Date of Patent: Sep. 13, 2016

(54) OUTSOLE

(75) Inventor: Hans Georg Braunschweiler, Rüschlikon (CH)

(73) Assignee: GLIDE'N LOCK AG, Ruschlikon (CH)

( * ) Notice: Subject to any disclaimer, the term of this patent is extended or adjusted under 35 U.S.C. 154(b) by 623 days.

(21) Appl. No.: 13/878,286

(22) PCT Filed: Aug. 17, 2011

(86) PCT No.: PCT/EP2011/064186

§ 371 (c)(1),
(2), (4) Date: Jun. 25, 2013

(87) PCT Pub. No.: WO2012/045512

PCT Pub. Date: Apr. 12, 2012

(65) Prior Publication Data

US 2013/0263469 A1 Oct. 10, 2013

(30) Foreign Application Priority Data

Oct. 7, 2010 (CH) ..... 1635/10

(51) Int. Cl.
*A43B 13/18* (2006.01)
*A43B 13/22* (2006.01)

(52) U.S. Cl.
CPC ..... *A43B 13/184* (2013.01); *A43B 13/186* (2013.01); *A43B 13/223* (2013.01)

(58) Field of Classification Search
CPC . A42B 13/184; A42B 13/186; A43B 13/223
USPC .. 36/134, 59 R, 62, 67 C, 67 D, 59 A, 59 C, 36/29, 28
See application file for complete search history.

(56) References Cited

U.S. PATENT DOCUMENTS

| | | | | |
|---|---|---|---|---|
| 4,741,114 A | | 5/1988 | Stubblefield | |
| 5,761,832 A | * | 6/1998 | George | A43B 13/223 36/103 |
| 5,768,802 A | * | 6/1998 | Bramani | A43B 7/146 36/28 |
| 6,082,024 A | * | 7/2000 | Del Biondi | A43B 7/14 36/28 |
| 7,784,196 B1 | * | 8/2010 | Christensen | A43B 13/184 36/29 |
| 8,322,051 B2 | * | 12/2012 | Auger | A43C 15/168 36/134 |
| 2004/0250451 A1 | * | 12/2004 | McMullin | A43C 15/16 36/59 R |

(Continued)

FOREIGN PATENT DOCUMENTS

| | | | | |
|---|---|---|---|---|
| CA | 1097064 A1 | | 3/1981 | |
| CH | WO 2006089448 A1 | * | 8/2006 | A43B 13/184 |

(Continued)

*Primary Examiner* — Ted Kavanaugh
(74) *Attorney, Agent, or Firm* — D. Peter Hochberg; Sean F. Mellino

(57) ABSTRACT

An outsole, in which in the heel and ball regions several elements protrude downward with respect to a stop surface which surrounds the outsole on all sides. The elements can be deformed vertically and/or horizontally to all sides by the forces acting thereon during walking until they are aligned with the stop surface. At least two groups of elements are provided. With respect to the elements of a first group a force that is at least 10 N higher is required than with respect to the elements of a second group in order to bring the elements into alignment with the stop surface by vertical deformation. With respect to the elements of the first group force that is at least 5 N lower is required than with respect to the elements of the second group in order to bring the elements into alignment with the stop surface by horizontal deformation.

18 Claims, 3 Drawing Sheets

A–A'

(56) References Cited

U.S. PATENT DOCUMENTS

| | | | | |
|---|---|---|---|---|
| 2008/0201992 | A1 | 8/2008 | Avar et al. | |
| 2008/0209766 | A1* | 9/2008 | Braunschweiler ... | A43B 13/184 36/102 |
| 2008/0271342 | A1 | 11/2008 | Lucas et al. | |
| 2011/0192056 | A1* | 8/2011 | Geser ..... | A43C 15/14 36/114 |
| 2012/0167412 | A1* | 7/2012 | Braunschweiler ... | A43B 13/184 36/28 |

FOREIGN PATENT DOCUMENTS

| | | | |
|---|---|---|---|
| CN | 101128131 | A | 2/2008 |
| FR | 2 695 809 | A1 | 3/1994 |
| JP | 5 309001 | A | 11/1993 |
| RU | 2238016 | C2 | 10/2004 |
| RU | 2385140 | C2 | 3/2010 |
| WO | 00/10417 | | 3/2000 |
| WO | WO 03/103430 | A1 | 12/2003 |
| WO | WO 2006/089448 | A1 | 8/2006 |

* cited by examiner

A–A'

Fig.2
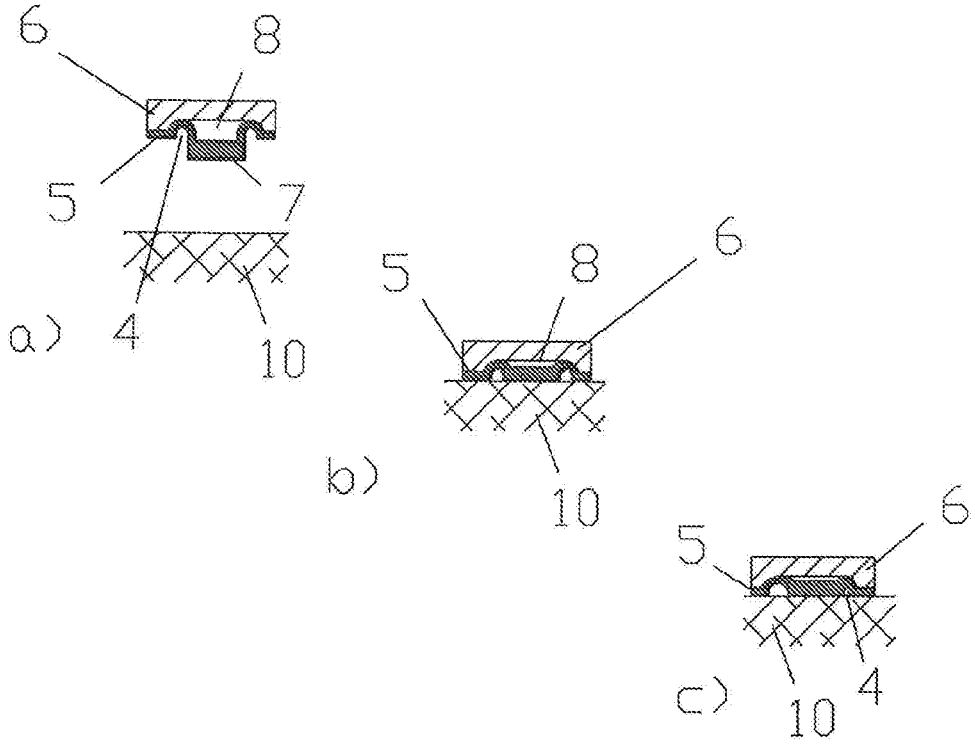
A–A'
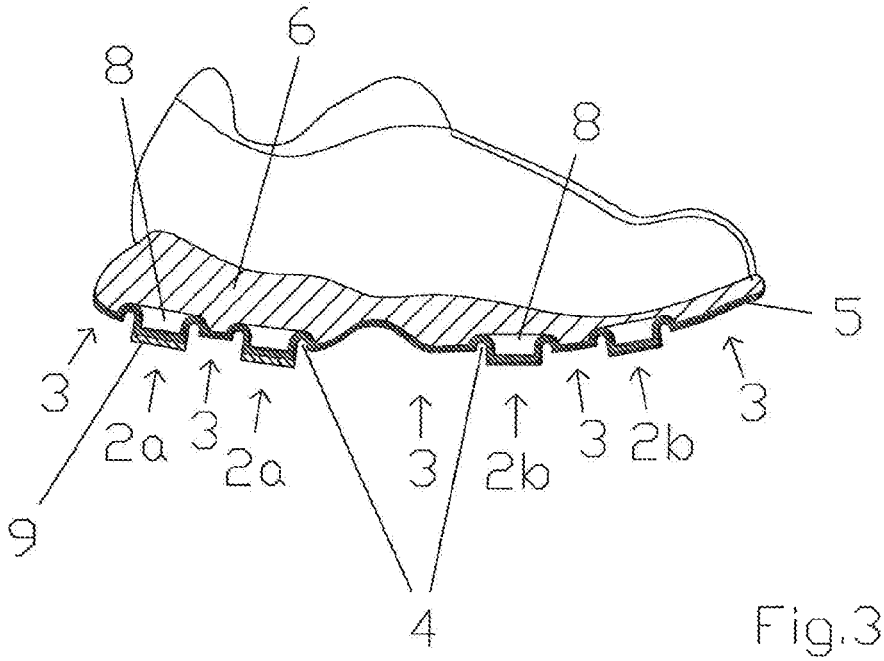
Fig.3

Fig.4a)
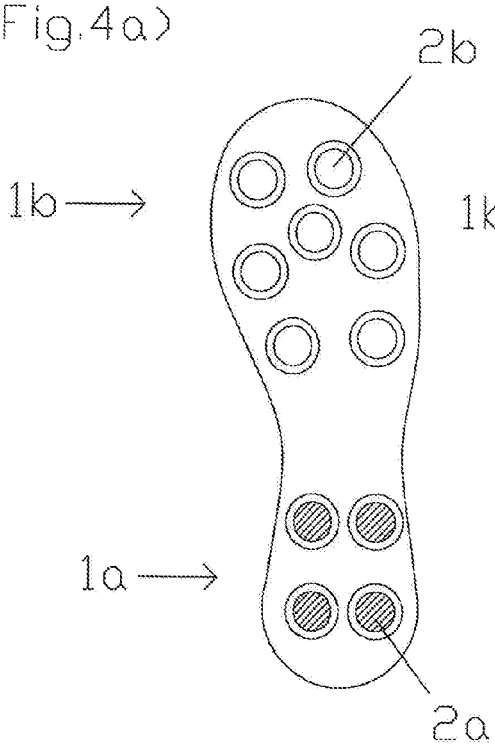
Fig.4b)
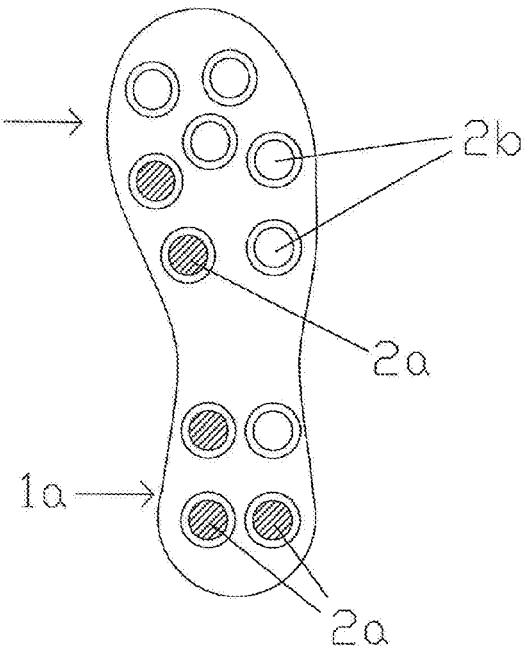
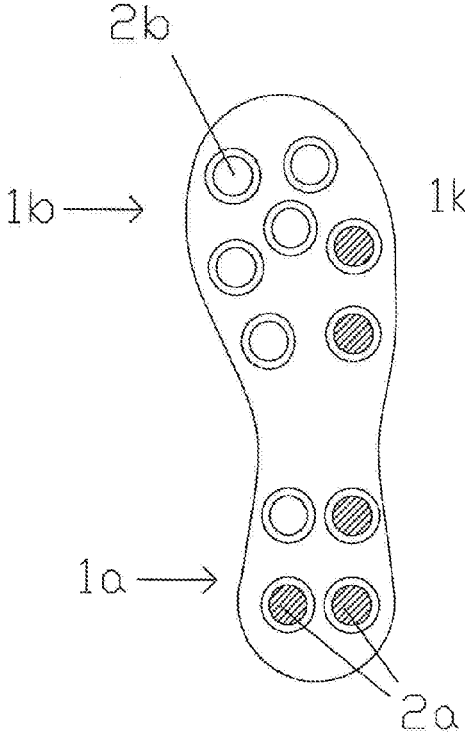
Fig.4c)
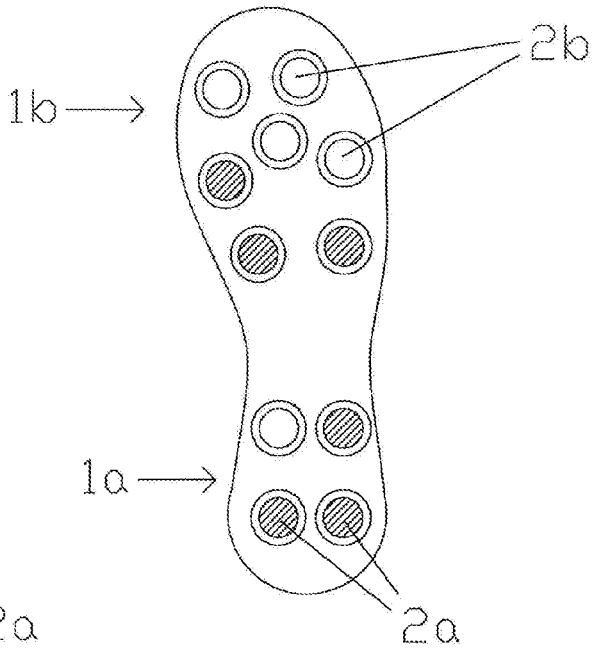
Fig.4d)

OUTSOLE

CROSS-REFERENCE TO RELATED APPLICATIONS

This application is a National Stage application of International Application No. PCT/EP2011/064186, filed on Aug. 17, 2011, which claims priority of Swiss application Serial Number 01635/10, filed on Oct. 7, 2010, both of which are incorporated herein by reference in their entireties.

BACKGROUND OF THE INVENTION

1. Field of the Invention

The present invention relates to an outsole, in which, in the heel region and in the ball-of-the-foot region, a plurality of elements project downwards in relation to a stop surface which surrounds the elements on all sides. It is possible, as a result of the forces acting thereon during running, for the elements to be deformed into alignment with the stop surface vertically and/or horizontally toward all sides.

2. Description of the Prior Art

A large number of a wide variety of different designs of elastically compliant outsoles are known, wherein use is made of elastic materials with a wide variety of different hardness levels. Outsoles with air cushions or gel cushions incorporated therein are also known. These are intended to cushion the loading which occurs during running and thus to safeguard the runner's locomotor system, in particular his or her joints, and also to provide a comfortable running sensation.

Most running shoes which are commercially available at present have spring characteristics which allow resilience primarily in the vertical direction, or in the direction perpendicular to the running surface, with compression of the sole, but are relatively rigid in the horizontal or tangential direction and, to this extent, are not sufficiently compliant when the foot is placed obliquely, and with some degree of sliding action, on the ground. The reason for the latter appears to be, inter alia, that a relatively high level of deformability of the sole in the horizontal direction would generate a kind of floating effect, which would in turn adversely affect the stability and steadiness of the runner. It would also be the case that, with each step, the runner would lose a certain amount of ground since, when the foot is pushed off from the point of placement, the sole would in each case first of all deform to some extent in the direction opposite to that for placing the foot on the ground. It is of course already the case to a certain extent that the floating effect occurs in commercially available sports shoes. In order to avoid this effect, most of these sports shoes have the front region of the sole, from which the foot is usually pushed off, designed in a relatively hard and uncompliant manner.

WO 03/103430 discloses outsoles which avoid the floating effect, despite pronounced tangential deformability, in that, beyond at least one critical deformation, in the region deformed to this extent, they are essentially stiff in relation to tangential deformation. Once the critical deformation has been reached, the runner is steady at the respective point of foot placement or loading point, from which he can push off again without losing ground. WO 03/103430 describes various exemplary embodiments which give a good understanding of the solution principle of the tangential deformability of the sole in conjunction with the rigidity of the latter beyond the at least one critical deformation.

WO 2006/089448 discloses further-developed embodiments of outsoles which function in accordance with the principle described in WO 03/103430. The functionalities which are necessary for the desired effect here, that is to say the tangential deformability and the rigidity in relation to tangential deformation beyond at least one critical deformation, are assigned, on the one hand, to a vertically and horizontally deformable element and, on the other hand, to a stop surface. These deformable elements and the stop surfaces are arranged such that, during rolling action over the heels and/or over the ball-of-the-foot region of the outsole, it is always the case that the two functionalities are used sufficiently closely together in terms of time and space.

Great differences in respect of their predominant loading can be determined from the wear patterns on outsoles which have been used for a relatively long time by different runners. These differences stem from different running styles which are characteristic of the individual runners. Differences also arise as a result of the different running distances. For example, short-distance runners run predominantly on the front of their feet, with loading in practice only on the ball-of-the-foot region. In contrast, long-distance runners usually land on the heel and roll over the entire foot. A distinction is drawn here between those who run on the outside of the foot and those who run on the inside of the foot. Those who run on the outside of the foot land on the outside of the heel, roll over the outer region of the midfoot and push off also in the outer ball-of-the-foot region or in the region of the four smaller toes. The reverse is the case for those who run on the inside of the foot. There are also mixed forms in which, for example, the runner lands on the outside of the foot, rolls transversally over the midfoot and pushes off from the region of the big toe, and vice versa. Since they are capable of being deformed vertically, but also tangentially in the forward, rearward and sideways directions, the outsoles which are known from WO 2006/089448 can adapt themselves well to all of these different types of loading and can follow the natural movements of the foot.

SUMMARY OF THE PRESENT INVENTION

It is an object of the present invention, then, to specify outsoles of the type mentioned in the introduction which are even better adapted to the various running styles.

The invention achieves this for such an outsole by the features of the presently claimed invention. In an outsole here in which, in the heel region and in the ball-of-the-foot region, a plurality of elements project downward in relation to a stop surface which surrounds the elements on all sides in each case, it being possible for said elements, as a result of the forces acting thereon during running, to be deformed into alignment with the stop surface vertically and/or horizontally toward all sides, at least two groups of elements are present. On the one hand, around at least 10 N more force is necessary in respect of the elements of a first group than in respect of the elements of a second group in order to bring the same into alignment with the stop surface by vertical deformation. On the other hand, around at least 5 N less force is necessary in respect of the elements of the first group than in respect of the elements of the second group in order to bring the same into alignment with the stop surface by horizontal deformation.

The differences in respect of the deformation forces which have to be applied are preferably even greater, and therefore around at least 20 N, preferably around 30 N, more force is necessary in respect of the elements of the first group than in respect of the elements of the second group in order to bring the same into alignment with the stop surface by vertical deformation, and therefore around at least 7.5 N, preferably 10 N, less force is necessary in respect of the elements of the first group than in respect of the elements of the second group in order to bring the same into alignment with the stop surface by horizontal deformation.

Dividing the elements up in two groups with different properties in respect of their deformability has the advantage that the various elements, depending on the runner's running style, can be arranged in different regions of the outsole. The regions of the outsole in which the runner primarily places his foot on the ground are subjected to the highest forces, with a simultaneously large tangential component, at the moment of foot placement. The elements of the first group are preferred for these regions. Conversely, those regions of the outsoles over which the runner rolls, and from which he pushes off again, are usually subjected to lower forces, wherein the tangential component is also less pronounced. The elements of the second group are preferred in these regions.

Skilled arrangement of the various elements allows the outsole to be optimally adapted to the runner's running style. Therefore, the elements of the first group can predominate in the heel region and the elements of the second group can predominate in the ball-of-the-foot region. The elements of the first group may be arranged in each case predominantly on the inside or predominantly on the outside in the heel region and in the ball-of-the-foot region. Or the elements of the first group may be arranged predominantly on the inside or predominantly on the outside in the heel region and be in the converse arrangement in the ball-of-the-foot region. Depending on the loading pattern, other arrangements are also possible.

The elements may be configured, for example, such that the elements of the first group project downward by 5-7 mm, preferably by 6 mm, in relation to the stop surface and by 1-3 mm, preferably by 2 mm, in relation to the elements of the second group.

In order to bring the elements of the first group into alignment with the stop surface by vertical deformation, for example forces of 170-190 N, preferably 180 N, may be necessary. In order to bring them into alignment with the stop surface by horizontal deformation, for example forces of 35-45 N, preferably 40 N, may be necessary.

In order to bring the elements of the second group into alignment with the stop surface by vertical deformation, for example forces of 140-160 N, preferably 150 N, may be necessary. In order to bring them into alignment with the stop surface by horizontal deformation, for example forces of 45-55 N, preferably 50 N, may be necessary.

It is possible for the elements to be designed in the form of platforms, or to be rotationally symmetrical, or else to be oval or angular. They are preferably hollow above a preferably planar, or slightly curved, base. They are surrounded on all sides preferably by a groove in relation to the stop surface, it being possible for the elements to be deformed at least part of the way into said groove. The elements of the first group can project further downward beyond the stop surface than the elements of the second group, as a result of having, for example, a thicker base than the latter. The base at least of one element of the first group may be thickened, for example, by a bonded-on pad. The elements may consist of an elastomer which is sufficiently resistant to the loading which occurs and also has a good grip.

BRIEF DESCRIPTION OF THE DRAWINGS

The invention will be explained in more detail hereinbelow with reference to exemplary embodiments and in conjunction with the drawings, in which:

FIG. 2 shows a section through an element at a) prior to deformation, at b) during vertical deformation, and at c) during vertical and horizontal deformation;

FIG. 3 shows the section A-A' from FIG. 1*a*) with elements thickened by pads; and FIG. 4 shows an outsole according to the invention with two groups of elements, with various arrangements of the groups shown a)-d).

DETAILED DESCRIPTION OF THE PRESENT INVENTION

Figure 1A:
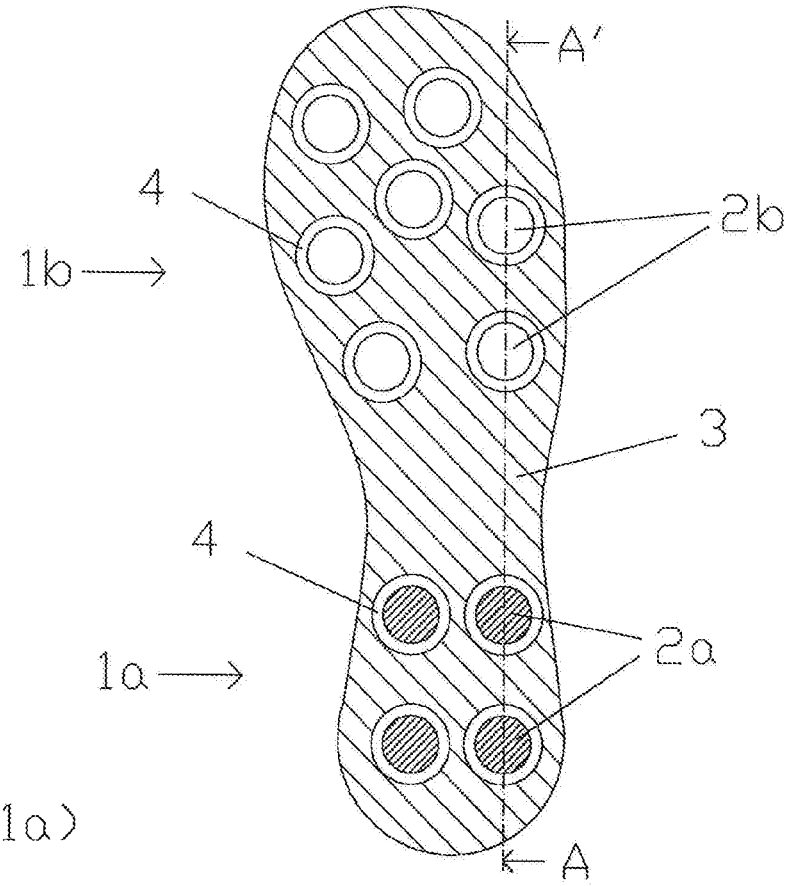
FIG. 1 shows at a), an outsole according to the invention with two groups of elements and, at b), a section A-A' through the outsole and the elements.

FIG. 1*a*) shows the running surface of an outsole according to the invention in a view from beneath (bottom view). The outsole has a plurality of rotationally symmetrical elements 2*a*, 2*b* in the form of platforms in the heel region 1*a* and in the ball-of-the-foot region 1*b*. Four elements 2*a* are arranged in the heel region 1*a* such that in each case two elements are located on the inside, on the outside, at the front and at the rear. Seven elements 2*b* are arranged in the ball-of-the-foot region 1*b*, three of these elements being located on the inside and three being located on the outside. The seventh element is located centrally in the front region. The two foremost elements are arranged in the vicinity of the toe region of the outsole. There are no elements on that region of the outsole which is located between the heel region 1*a* and the ball-of-the-foot region 1*b*.

The elements 2*a*, 2*b* are surrounded on all sides in each case by a stop surface 3. A groove 4 is present between the elements 2*a*, 2*b* and the stop surface 3, this groove surrounding the elements 2*a*, 2*b* on all sides.

Figure 1B:
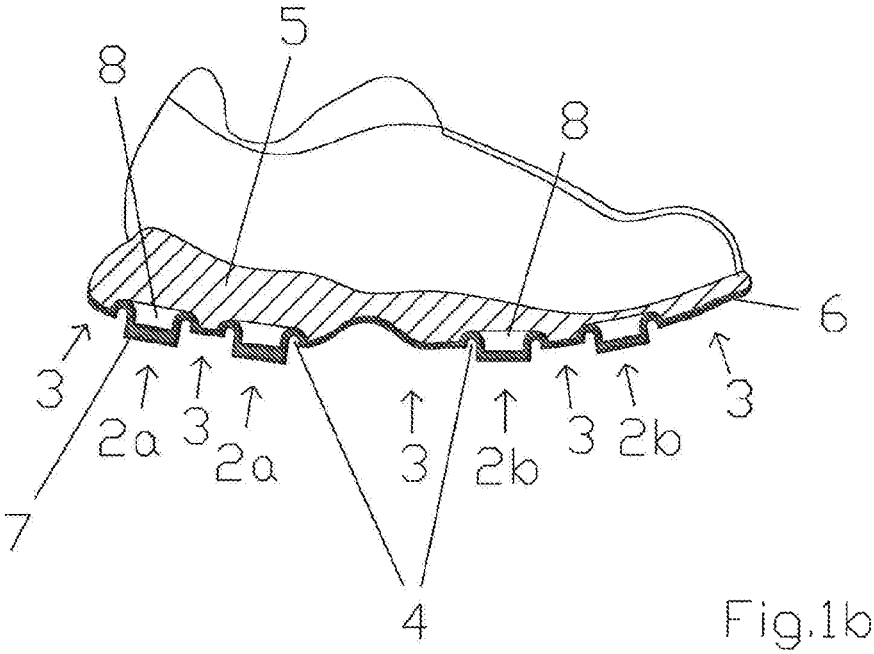

FIG. 1*b*) shows a section A-A' through the outsole from FIG. 1*a*. A layer 6 made of an elastically deformable material such as Phylon or polyurethane is applied to the underside of an outsole, or to the midsole 5 thereof. The midsole 5 has recesses in the regions of the elements 2*a*, 2*b*. The layer 6 is made in one piece from a resistant elastomer and forms the stop surface 3 and the elements 2*a*, 2*b*. The layer 6 may also be made in more than one piece. The groove 4 is located in each case between the stop surface 3 and the elements 2*a*, 2*b*. In the non-loaded state, the elements 2*a*, 2*b* project downward in relation to the stop surface 3. They have a planar, or slightly curved, base 7. Between the planar base 7 and the midsole 5, a cavity 8 is present in the region of the recesses. In the region of the stop surface 3, the layer 6 is applied directly to the midsole 5.

The elements 2*a*, 2*b* are divided up into a first group 2*a* and into a second group 2*b*. In the non-loaded state, the elements of the first group 2*a* project downward by 5-7 mm, preferably by 6 mm, in relation to the stop surface 3 and by 1-3 mm, preferably by 2 mm, in relation to the elements of the second group 2*b*.

As is shown in FIGS. 2*a*) to 2*c*), the elements 2*a*, 2*b* of the outsole can be deformed vertically (FIG. 2*b*)) and/or horizontally toward all sides (FIG. 2*c*)) when the foot is placed on the ground 10. As a result of the forces acting on them when the foot is placed on the ground, the elements are compressed into alignment with the stop surface 3 and/or are deformed laterally into the groove 4, wherein around at least 10 N more force is necessary in respect of the elements of the first group 2*a* than in respect of the elements of the second group 2*b* in order to bring the same into alignment with the stop surface 3 by vertical deformation. In order to bring the elements into alignment with the stop surface 3 by horizontal deformation, around at least 5 N less force is necessary in respect of the elements of the first group 2*a* than in respect of the elements of the second group 2*b*.

In respect of vertical deformation, forces of 170-190 N, preferably 180 N, are necessary in order to bring the elements of the first group 2*a* into alignment with the stop surface 3. In contrast, lower forces of 140-160 N, and preferably 150 N, are necessary for the elements of the second group 2*b*. The difference in these forces of at least 10 N is achieved predominantly by the elements of the first group 2*a* projecting further downwards than the elements of the second group 2*b*. This means that the distance which has to be covered until the base 7 of the element of the first group 2*a* is brought into alignment with the stop surface 3, and therefore the force which is necessary, are greater.

The converse is the case for the forces for horizontal deformation. In respect of horizontal deformation, forces of 35-45 N, preferably 40 N are necessary in order to bring the elements of the first group 2*a* into alignment with the stop surface 3. Forces of 45-55 N, preferably 50 N, are necessary in order to bring the elements of the second group 2*b* into alignment with the stop surface 3. This difference in the forces of at least 5 N is also predominantly achieved by the elements of the first group 2*a* projecting further downward than the elements of the second group 2*b*. This means that the leverage for the higher elements of the group 2*a* is greater, for which reason it is also the case that less force has to be applied for the deformation.

The elements of the first group 2*a* project further downward beyond the stop surface 3 than the elements of the second group 2*b* as a result of having, for example, a thicker base 7 than the latter. The same effect is also achieved if the base 7 of the elements of the first group 2*a* is thickened by a bonded-on pad 9, as is shown in FIG. 3.

FIGS. 4*a*)-*d*) show, using the same illustration as in FIG. 1*a*), outsoles according to the invention with the two groups of elements 2*a*, 2*b* in different arrangements, only the soles for a left shoe being illustrated in each case. Of course, the respectively associated right shoe should be provided with a usually mirror-inverted arrangement, wherein it would be possible, for runners with differently sized feet or different foot positions, for the left shoe and the right shoe to be designed differently on an individual basis. The elements of the first group 2*a* are identified by hatching. The elements of the second group 2*b* do not have any hatching.

In FIG. 4*a*), the elements of the first group 2*a* are arranged in the heel region 1*a* and the elements of the second group 2*b* are arranged in the ball-of-the-foot region 1*b*. This arrangement is particularly suitable for long-distance runners, who "land" on the heel and roll over the ball-of-the-foot. For the purposes of cushioning and damping the first high loading peak in the heel region, these elements require a large amount of vertical resilient deflection in combination with easy horizontal deformability on account of the horizontal component likewise being large in this phase. These requirements are met precisely by the elements of the first group 2*a*. During the subsequent rolling action, the loading by the active forces is lower, and therefore the elements of the second group 2*b*, in respect of their vertical and horizontal deformability, are more advantageous and also perceived to be more comfortable. The arrangement of FIG. 4*a*) is also suitable for normal walking.

In FIGS. 4*b*)-*d*), elements of the first group 2*a* are also arranged in the ball-of-the-foot region 1*b* and, conversely, elements of the second group 2*b* are also arranged in the heel region 1*a*. However, the elements of the first group 2*a* still predominate in the heel region 1*a* and the elements of the second group 2*b* still predominate in the ball-of-the-foot region 1*b*.

In FIG. 4*b*), in addition, the elements of the first group 2*a* are arranged predominantly on the inside and the elements of the second group 2*b* are arranged predominantly on the outside. This arrangement is suitable specifically for those who run on the inside of the foot.

FIG. 4*c*) shows an embodiment which corresponds to FIG. 4*b*), but with the elements of the first group 2*a* arranged predominantly on the outside and with the elements of the second group 2*b* arranged predominantly on the inside, this being better suited to those who run predominantly on the outside of the foot.

In FIG. 4*d*), the elements of the first group 2*a* are arranged predominantly on the outside in the heel region 1*a* and are in the converse arrangement, arranged predominantly on the inside, in the ball-of-the-foot region 1*b*. This arrangement is advantageous for runners who roll transversely over the foot from the outside at the rear to the inside at the front. For probably rather uncommon rolling behavior from the inside at the rear to the outside at the front, it would be possible for the elements of the first group 2*a* also to be arranged predominantly on the inside in the heel region 1*a* and predominantly on the outside in the ball-of-the-foot region 1*b*.

Further distribution patterns of the different elements are, of course, likewise possible, and account can be taken of the specific movement patterns for different types of sport. Finally, it would be possible to provide, in addition, further elements with yet other characteristics.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. An outsole comprising a heel region, a ball-of-the-foot region and a plurality of elements in the heel region and in the ball-of-the-foot region, wherein a stop surface defines a surface of the heel region and the ball-of-the-foot region, and wherein, in the heel region and in the ball-of-the-foot region, the plurality of elements project downwards in relation to said stop surface, wherein the elements are deformed into alignment with the stop surface vertically and/or horizontally toward all sides in response to forces acting on the plurality of elements during running, wherein at least two groups of elements are present;

wherein at least 10 N more force is necessary in respect of the elements of a first group than in respect to the elements of a second group in order to bring the elements of the first group into alignment with the stop surface by vertical deformation;

and wherein at least 5 N less force is necessary in respect of the elements of the first group than in respect of the elements of the second group in order to bring the elements of the first group into alignment with the stop surface by horizontal deformation.

2. The outsole according to claim 1, wherein at least 20 N more force is necessary in respect of the elements of the first group than in respect of the elements of the second group in order to bring the elements of the first group into alignment with the stop surface by vertical deformation, and in that at least 7.5 N less force is necessary in respect of the elements of the first group than in respect of the elements of the second group in order to bring the elements of the first group into alignment with the stop surface by horizontal deformation.

3. The outsole according to claim 2, wherein at least 30 N more force is necessary in respect of the elements of the first group than in respect of the elements of the second group in order to bring the elements of the first group into alignment with the stop surface by vertical deformation, and in that at least 10 N less force is necessary in respect of the elements of the first group than in respect of the elements of the second group in order to bring the elements of the first group into alignment with the stop surface by horizontal deformation.

4. The outsole according to claim 1, wherein the elements of the first group predominate in the heel region and the elements of the second group predominate in the ball-of-the-foot region.

5. The outsole according to claim 1, wherein the heel region has an inside and an outside and the ball-of-the-foot region has an inside and an outside, and wherein the elements of the first group are arranged in each case predominantly on the inside or predominantly on the outside in the heel region and in the ball-of-the-foot region.

6. The outsole according to claim 1, wherein the elements of the first group are arranged in a selected one being predominantly on the inside or predominantly on the outside in the heel region, and are arranged in a respective converse arrangement in the ball-of-the-foot region relative to the arrangement in the heel region.

7. The outsole according to claim 1, wherein the elements of the first group project downwardly by 5-7 mm in relation to the stop surface and by 1-3 mm in relation to the elements of the second group.

8. The outsole according to claim 7, wherein the elements of the first group project downward by 6 mm in relation to the stop surface and by 2 mm in relation to the elements of the second group.

9. The outsole according to claim 1, wherein, in respect of the elements of the first group, 170-190 N are necessary in order to bring the elements of the first group into alignment with the stop surface by vertical deformation, and 35-45 N are necessary in order to bring the elements of the first group into alignment with the stop surface by horizontal deformation.

10. The outsole according to claim 9, wherein, in respect of the elements of the first group, 180 N are necessary in order to bring the elements of the first group into alignment with the stop surface by vertical deformation, and 40 N are necessary in order to bring the elements of the first group into alignment with the stop surface by horizontal deformation.

11. The outsole according to claim 1, wherein, in respect of the elements of the second group, 140-160 N are necessary in order to bring the first group into alignment with the stop surface by vertical deformation, and 45-55 N are necessary in order to bring the elements of the first group into alignment with the stop surface by horizontal deformation.

12. The outsole according to claim 11, wherein, in respect of the elements of the second group, 150 N are necessary in order to bring the elements of the first group into alignment with the stop surface by vertical deformation, and 50 N are necessary in order to bring the elements of the first group into alignment with the stop surface by horizontal deformation.

13. The outsole according to claim 1, wherein the elements are in the form of platforms, are rotationally symmetrical, and are hollow above a planar base, and wherein a groove surrounds the elements on all sides in relation to the stop surface, wherein the elements are deformable at least part of the way into said groove.

14. The outsole according to claim 13, wherein the elements of the first group project further downward beyond the stop surface than the elements of the second group, as a result of having a thicker base than the elements of the second group.

15. The outsole according to claim 14, further comprising a bonded-on pad for thickening the base of at least one element of the first group.

16. The outsole according to claim 1, wherein said stop surface surrounds each element of said plurality of elements on all sides.

17. An outsole comprising a heel region, a ball-of-the-foot region and a plurality of elements in the heel region and in the ball-of-the-foot region, wherein a stop surface defines a surface of the heel region and the ball-of-the-foot region, and wherein, in the heel region and in the ball-of-the-foot region, the plurality of elements project downwards in relation to said stop surface, wherein the elements are deformed into alignment with the stop surface vertically and/or horizontally toward all sides in response to forces acting on the plurality of elements during running, wherein at least two groups of elements are present;

wherein at least 10 N more force is necessary in respect of the elements of a first group than in respect to the elements of a second group in order to bring the elements of the first group into alignment with the stop surface by vertical deformation;

wherein at least 5 N less force is necessary in respect of the elements of the first group than in respect of the elements of the second group in order to bring the elements of the first group into alignment with the stop surface by horizontal deformation;

wherein the elements of the first group predominate in the heel region and wherein the elements of the second group predominate in the ball-of-the-foot region; and wherein the elements are rotationally symmetrical, are in the form of platforms, and are hollow above a planar base, and wherein a groove surrounds the elements on all sides in relation to the stop surface, wherein the elements are deformable at least part of the way into said groove.

18. An outsole comprising a heel region, a ball-of-the-foot region and a plurality of elements in the heel region and in the ball-of-the-foot region, wherein a stop surface defines a surface of the heel region and the ball-of-the-foot region, and wherein, in the heel region and in the ball-of-the-foot region, the plurality of elements project downwards in relation to said stop surface, wherein the elements are deformed into alignment with the stop surface vertically and/or horizontally toward all sides in response to forces acting on the plurality of elements during running, wherein at least two groups of elements are present;

wherein at least 10 N more force is necessary in respect of the elements of a first group than in respect to the elements of a second group in order to bring the elements of the first group into alignment with the stop surface by vertical deformation;

wherein at least 5 N less force is necessary in respect of the elements of the first group than in respect of the elements of the second group in order to bring the elements of the first group into alignment with the stop surface by horizontal deformation; and wherein the elements of the first group predominate in the heel region and wherein the elements of the second group predominate in the ball-of-the-foot region.

* * * * *